United States Patent [19]

Roberts

[11] Patent Number: 4,503,667

[45] Date of Patent: Mar. 12, 1985

[54] TURBINE OVERSPEED LIMITER FOR TURBOMACHINES

[75] Inventor: Derek A. Roberts, Bristol, England

[73] Assignee: Rolls-Royce Limited, London, England

[21] Appl. No.: 539,379

[22] Filed: Oct. 6, 1983

[30] Foreign Application Priority Data

Oct. 6, 1982 [GB] United Kingdom ..... 8228581

[51] Int. Cl.[3] ..... F02G 3/00; F01B 25/16; F01D 21/00

[52] U.S. Cl. ..... 60/39.091; 415/9

[58] Field of Search ..... 60/39.091; 415/9; 416/247; 94/609

[56] References Cited

U.S. PATENT DOCUMENTS

| | | | |
|---|---|---|---|
| 1,634,897 | 7/1927 | Davis | 415/9 |
| 2,976,012 | 3/1961 | Allen | 415/9 |
| 3,075,741 | 1/1963 | Laubin | 415/9 |
| 3,490,748 | 1/1970 | Hoffman | 415/9 |
| 3,989,407 | 11/1976 | Cunningham | 60/39.091 |
| 4,004,860 | 1/1977 | Gee | 415/9 |

FOREIGN PATENT DOCUMENTS

| | | | |
|---|---|---|---|
| 624166 | 12/1961 | Canada | 415/9 |
| 993711 | 6/1965 | United Kingdom | 415/9 |
| 2002857 | 2/1979 | United Kingdom | 60/39.091 |

*Primary Examiner*—Louis J. Casaregola
*Attorney, Agent, or Firm*—Parkhurst & Oliff

[57] ABSTRACT

A turbine rotor 14 of a gas turbine engine is provided with a mechanism 25 designed to tilt into the path of the turbine rotor blades to decelerate the rotor if a shaft 24, which connects the turbine rotor 14 to a compressor rotor 12 breaks. The mechanism 25 comprises a segmented stator vane assembly 26 in which the segments are supported at an upstream region of their radial inner ends on a deflectable strut 44 and by means of a tie 46 at a downstream region of their radial inner ends. When the shaft 24 breaks, the rearward movement of the rotor 14 is used to unlatch the strut 44 causing the NGV segments 26 to collapse inwards and tilt forwards into the path of the turbine rotor blades to decelerate the rotor. The NGV segments 26 and the turbine rotor blades destroy each other and the resulting debris is ejected out of the jet pipe 22 destroying further downstream turbine stages.

7 Claims, 4 Drawing Figures

TURBINE OVERSPEED LIMITER FOR TURBOMACHINES

Figure 1:
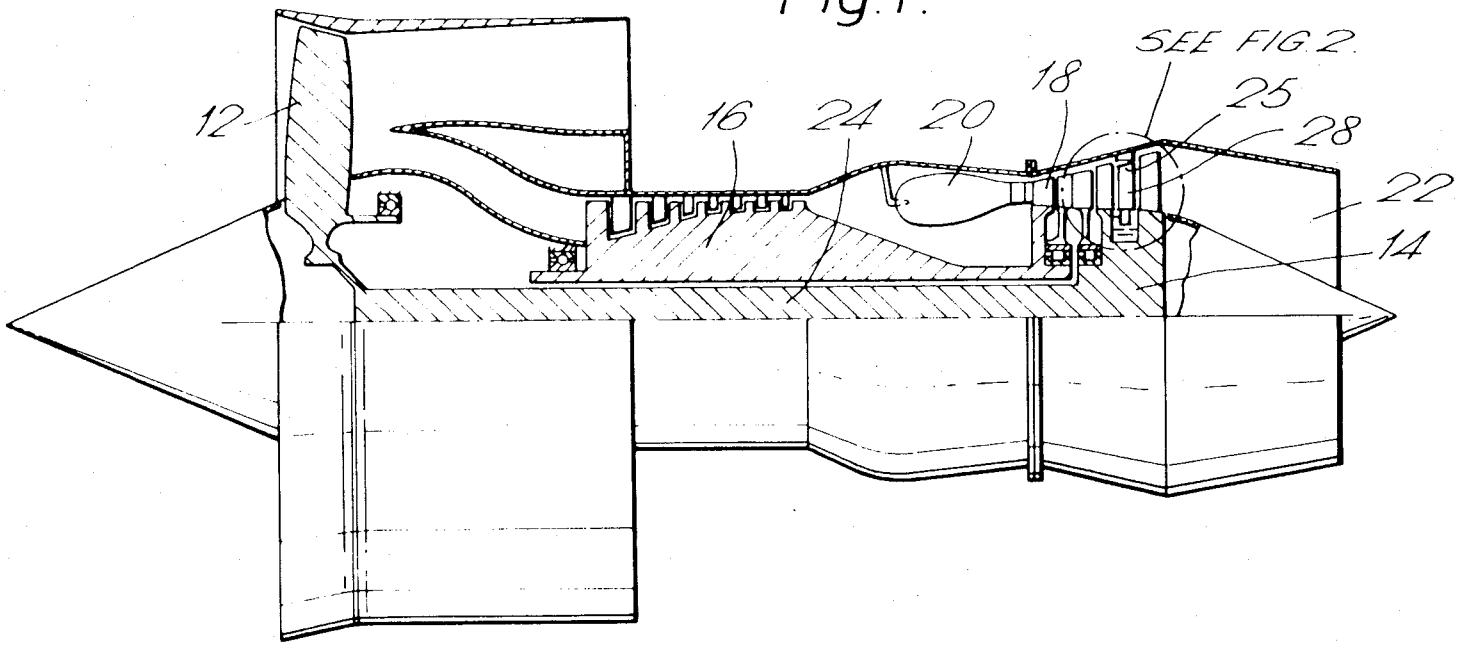

This invention relates to a mechanism for preventing a turbine rotor of a gas turbine engine rotating at an unsafe speed.

A primary requisite in the design of gas turbine engines is that a failure of any component of the engine should not jeopardise the safety of the aircraft to which the engine is fitted, no matter how remote the likeliness of such a failure may be.

This invention addresses itself specifically to the problem of the failure of a shaft which connects a turbine rotor to a compressor or fan rotor.

During normal running the compressor and turbine rotors run at speeds up to predetermined maximum. The aerodynamic forces on the blades of the turbine drive the compressor, and the aerodynamic forces on the compressor oppose the rotation of the turbine rotor. Similarly, the axial load on the turbine is largely balanced by the axial load on the compressor. If a shaft connecting the turbine rotor to the compressor rotor were to break the aerodynamic loads on the turbine rotor accelerate it very rapidly (within a few milliseconds) as there is no opposition provided by the compressor rotor. Consequently, the turbine rotor can accelerate to a speed at which the disc or drum retaining the turbine blades bursts. The blades and disc fragments are then released and subject to an extremely high centrifugal force which can propel them through the engine casings. To provide structure to ensure that in these extreme, and unlikely conditions, all the ejected blades and disc fragments are contained within the engine casings would be very heavy and costly. There is, therefore, a risk that one or more of the blades or disc fragments could damage the aircraft.

The design of the attachments of the compressor rotor to its driving turbine and to the thrust bearing supporting the shaft may be such that if the shaft fails, the turbine rotor is not supported in the thrust bearing but is free to move axially, under the influence of its axial load, and is no longer balanced by the compressor.

It can be shown that simply allowing the rotor to run against a fixed stator structure downstream of the rotor will have no appreciable effect in slowing the rotor down because the heat generated by friction would melt the surfaces of the rotor and the stator vane structures and provide liquid metal lubrication of the rotor for a greater time than it takes for the disc to burst.

The present invention resides in the appreciation that it is possible to design a structure which makes use of the axial movement of the rotor to initiate deceleration of the rotor to safe speeds at which the blades are less likely to be ejected through the engine casings.

An object of this invention is to provide a mechanism for preventing a turbine rotor of a gas turbine engine exceeding a predetermined speed if a shaft, connecting the turbine rotor to a compressor rotor, breaks and releases its torsional and axial constraint on the turbine rotor.

The present invention, as claimed, makes use of the rearwards axial movement of the turbine rotor when the shaft breaks to initiate the release of segments of a stator vane assembly immediately downstream of the turbine rotor and cause them to collide with the turbine rotor blades to decelerate the rotor by destroying the rotor blades in a controlled manner.

Figure 2:
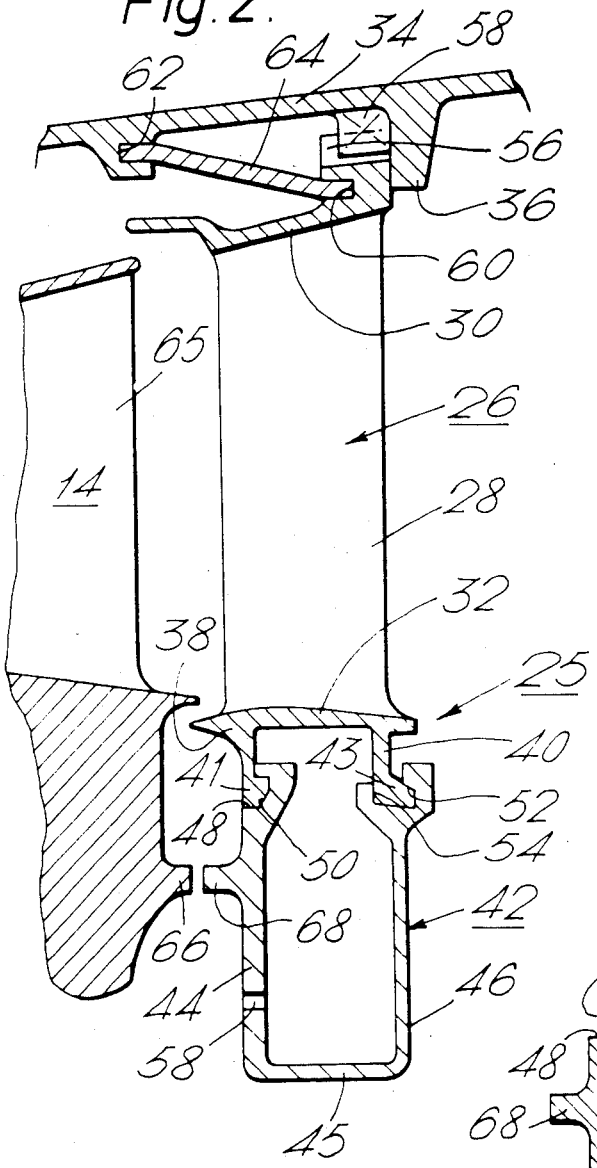
Figure 4:
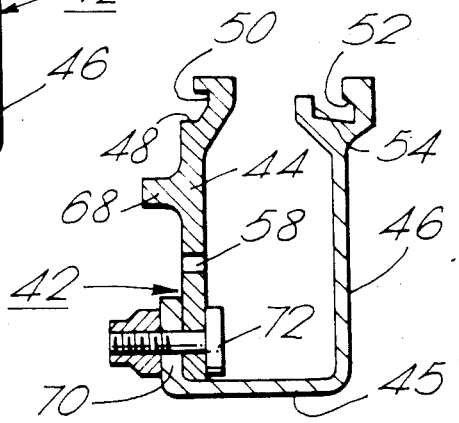
Figure 3:
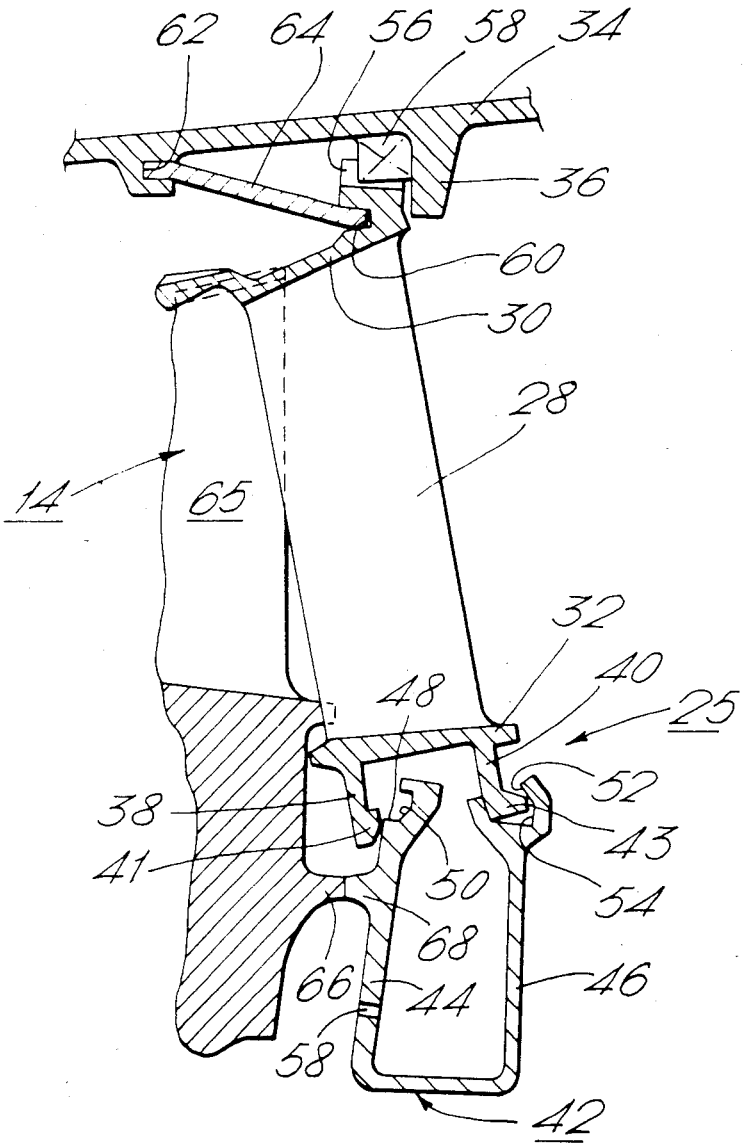

The invention will now be described, by way of an example, with reference to the accompanying drawings, in which, FIG. 1 illustrates, schematically a gas turbine engine incorporating a mechanism 25, constructed in accordancd with the present invention, for preventing a turbine rotor 14 exceeding a predetermined speed if the shaft connecting the turbine rotor to a compressor rotor breaks, FIG. 2 is a radial cross sectional view of the turbine 14 of the engine of FIG. 1, and shows, in more detail the mechanism 25, during normal engine running, FIG. 3 is a radial cross sectional view of the turbine 14 of the engine of FIG. 1, and shows, in more detail, the mechanism 25 after the shaft has broken and the rotor has moved rearwards, and, FIG. 4 illustrates a modification of the structure on which the stator vane segments 26 of mechanism 25 are mounted.

Referring to FIG. 1 there is shown a two spool gas turbine engine of the by-pass type. The engine comprises, a low pressure compressor fan 12 driven by a low pressure turbine 14, a multi-stage axial flow high pressure compressor 16 driven by a high pressure turbine 18, a combustion chamber 20 and a jet pipe 22.

The mechanism for preventing the turbine 14 exceeding a predetermined safe speed in the event of the shaft 24 (which connects the turbine rotor 14 to the compressor fan 12) breaking is shown by the reference numeral 25. For convenience, only the turbine 14 is shown as incorporating the mechanism 25 although it is to be understood that the turbine 18 may also incorporate a similar mechanism to that shown by the numeral 25 if desired.

Referring specifically to FIGS. 2 and 3, the turbine 14 is, in this example, a two stage turbine. The mechanism 25 for preventing the turbine rotor overspeeding is constituted, in part by the interstage nozzle guide vane assembly 26. The NGV assembly 26 comprises a plurality of segments 26 each consisting of one or a plurality of stator vanes 28 extending between inner and outer shrouds 30,32 respectively.

The outer casing 34 of the turbine is provided with an inward projecting flange 36 that forms an abutment face against which the outer shrouds 32 bear, and constrains the segments 26 against bodily movement rearwards.

The radially inner ends of the segments 26 are each provided with two axially spaced flanges 38,40 projecting radially inwards. Each of these flanges 38,40 is provided with a hook 41,43 that locates in recesses in inner structure 42 of the engine.

The inner structure 42 comprises a cylindrical member 45 which has two flanges 44,46 projecting radially outwards. The flanges 44,46 are relatively flexible in bending in an axial direction.

The first flange 44 is located at an upstream region of the structure 42 and is constructed to provide a radially outward facing abutment face 48 and a forward facing abutment face 50 against which the flange 38 bears. The second flange 46 is located at a downstream region of the structure 42 and is constructed to provide a radially inward facing abutment face 52 and a rearward facing abutment face 54 against which bears the flange 40. In this way the flange 44 forms a strut and the flange 46 forms a tie that opposes the axial turning moment on the nozzle guide vane assembly 26 due to gas loads. The principle axial constraint of the segments 26 is provided at the outer ends of the segments 26 by the flange 36.

The axial load on structure 42 in normal running is transmitted to the segments 26 by the flange and face 54 and is reacted by the outer casing flange 36. Bending moments on the segments 26 are resisted by the faces 48 and 52 in flanges 44 and 46 respectively. Torsional gas loads on the stator vanes 28 are reacted by dogs 56 on the outer ends of the segments which contact stops 58 on the outer casing 34.

The segments 26 are provided with a forward facing abutment face 60 (in the form of a circumferential recess) and the outer casing 34 is provided with a rearward facing abutment face 62 (again in the form of a circumferential recess). Circumferentially spaced bridging members 64 are located between the abutment faces 60,62 and serve to hold the outer ends of the segments in position against the flange 36. The members 64 also provide a fulcrum at their downstream ends when it is required for the segments 26 to tilt into the path of the rotor blades 65, as will be explained later.

To prevent the flanges 44,46 unlatching and releasing the inner ends of the segments unintentionally due to gas pressures acting on the upstream side of flanges 44, the flanges 44 are provided with a vent 58 to allow pressurised gas to enter the interior of the hollow box defined by the flanges 44,46 and the segments. The shapes of the turbine rotor and structure 42 are such that when rearwards movement occurs the first substantial contact takes place on the flange 44, for example by providing a cylindrical projection 66 on the turbine disc. The flange 44 is also provided with a cylindrical projection 68. These projections 66,68 ensure that when the rotor moves axially as a result of shaft 24 breaking, the projection 66 is the first part of the turbine to strike the structure 42.

Rearward movement of the turbine rotor 14 thereby pushes the flange 44 rearwards to a position where it no longer acts as a strut and the segments collapse inwards (as shown in FIG. 3). This causes the radially outer upstream ends of the segments 26 to tilt into the path of the blades 65 of the turbine rotor breaking them into smaller pieces, which are ejected rearwards into the next stage of the turbine rotor. The debris ejected into downstream stages of the turbine 14 destroys the blades of the downstream stages of the turbine rotor (and other turbines in those engines with further turbines downstream). In addition, the downstream inner ends of the segments 26 collide with the second stage of the turbine rotor 14 to destroy its blades as well.

Consequently the aerodynamic efficiency of the turbine is destroyed and the loss of power together with the physical entanglement decelerates the rotor to a safe speed and prevents it bursting.

Referring to FIG. 4 the flange 44 of the structure 42 on which the segments 26 are mounted, is constructed as a separate flange which is bolted on to a short radial flange 70 on the cylindrical part of the structure 42 by bolts 72. The flange 70 and the inner region of the flange 44 are scalloped so that they may be assembled by a bayonetting action and indexing the flange 44 around the flange 70 to align the bolt holes.

I claim:

1. A mechanism for preventing a turbine rotor of a gas turbine engine exceeding a predetermined speed if a shaft, connecting the turbine rotor to a compressor rotor, breaks and releases its torsional and axial constraint on the turbine rotor, the mechanism comprising a segmented stator vane assembly downstream of a stage of the turbine rotor, a constraining means operable to constrain the radially outer ends of the segments of the assembly against displacement bodily in a downstream direction, and static structure of the engine on which the radially inner ends of the segments are mounted, the structure including a releasable means which is operable, when struck in an axial direction by the rotor as a result of the shaft breaking, to release the inner ends of the segments and allow the segments to tilt into the path of the turbine rotor blades and thereby destroy the blades and decelerate the turbine rotor.

2. A mechanism according to claim 1 wherein the structure on which the segments are mounted includes a releasable catch which holds the segments in position downstream of the rotor stage, and is operable when struck in an axial direction to release the radially inner ends of the segments.

3. A mechanism according to claim 1 wherein the releasable means comprises one or more struts and the, or each strut, in use of the engine, exerts a radially outwards force on an upstream region of the inner ends of the segments, and the or each strut is constructed so that it is rendered inoperative as a support for the segments when the structure is struck by the rotor in an axial direction as a result of the shaft breaking, and the upstream radially inner ends of the segments are caused to collapse radially inwards as a result of the gas loads on the stator vanes and thereby tilt into the path of the turbine rotor blades.

4. A mechanism according to claim 1 wherein the releasable means further includes one or more ties and the, or each, tie in use of the engine exerts a radially inwards force on a downstream region of each segment, and the, or each, tie is constructed to release the segments simultaneously when the, or each, strut is rendered inoperative as a support for the segments.

5. A mechanism according to claim 1 wherein the releasable means comprises a hollow cylindrical member having a first circumferential flange extending towards an upstream region of the inner ends of the segments and the first flange constituting a strut, in use of the engine, and being constructed to provide a radially outward facing abutment face and a forwards facing abutment face, the cylindrical member having a second circumferential flange extending towards the downstream inner ends of the segments and constructed as a tie in use of the engine to provide a radially inward facing abutment face and a rearwards facing abutment face, and each of the segments being provided respectively at their upstream and downstream inner ends with first and second members that bear against respectively the abutment faces provided by the first and second flanges.

6. A mechanism according to claim 5 wherein the first and second flanges of the releasable means, together with the segments define a hollow annular box and a vent is provided to connect the interior of the box on the downstream side of the first flange with a space on the upstream side of the first flange.

7. A mechanism according to claim 1 wherein the constraining means at the radially outer ends of the segments comprises: an outer casing for the turbine having two abutment faces, a first of which is located adjacent the downstream edge of each segment against which the segments abut to restrict their axial movement in a downstream direction, and a second of the abutment faces facing in a downstream direction; an abutment of the segments adjacent a downstream region of its outer end, these abutment faces being positioned to face in an upstream direction, and a plurality of circumferentially spaced bridging members each of which extends between the second abutment face on the outer casing and the abutment face on one of the segments.

* * * * *